US008187999B2

(12) United States Patent
Fukui

(10) Patent No.: US 8,187,999 B2
(45) Date of Patent: May 29, 2012

(54) THERMAL TRANSFER SHEET

(75) Inventor: Daisuke Fukui, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 950 days.

(21) Appl. No.: 11/910,115

(22) PCT Filed: Mar. 31, 2006

(86) PCT No.: PCT/JP2006/306923

§ 371 (c)(1),
(2), (4) Date: Aug. 11, 2008

(87) PCT Pub. No.: WO2006/106958

PCT Pub. Date: Oct. 12, 2006

(65) Prior Publication Data

US 2009/0202754 A1 Aug. 13, 2009

(30) Foreign Application Priority Data

Mar. 31, 2005 (JP) ..... 2005-105348

(51) Int. Cl.
*B41M 5/035* (2006.01)
*B41M 5/382* (2006.01)
*B41M 5/50* (2006.01)

(52) U.S. Cl. ..... 503/227; 428/32.68

(58) Field of Classification Search ..... None
See application file for complete search history.

(56) References Cited

U.S. PATENT DOCUMENTS

| | | | |
|---|---|---|---|
| 5,296,299 | A | 3/1994 | Makishima et al. |
| 5,968,871 | A | 10/1999 | Katashima et al. |
| 6,310,133 | B1 | 10/2001 | Katashima et al. |
| 2002/0032271 | A1 | 3/2002 | Katashima et al. |

FOREIGN PATENT DOCUMENTS

| | | |
|---|---|---|
| JP | 01-271288 | 10/1989 |
| JP | 02-020390 | 1/1990 |
| JP | 02-131990 | 5/1990 |
| JP | 02-147293 | 6/1990 |
| JP | 06-055868 | 3/1994 |
| JP | 07-329437 | 12/1995 |
| JP | 08-267942 | 10/1996 |
| JP | 08-300842 | 11/1996 |
| JP | 10-118565 | 5/1998 |
| JP | 2000-141896 A | 5/2000 |
| JP | 2000-272254 | 10/2000 |
| JP | 2001-001653 | 1/2001 |
| JP | 2001-158180 A | 6/2001 |

OTHER PUBLICATIONS

Office Action issued in related Japanese Application No. 2006-101175 with this full English translation.

*Primary Examiner* — Bruce H Hess

(74) *Attorney, Agent, or Firm* — Connolly Bove Lodge & Hutz LLP

(57) ABSTRACT

It is an object of the present invention to provide a thermal transfer sheet which has a conductive primer layer having adequate adhesion and heat resistance without using a binder resin, has an excellent antistatic property, and hardly causes troubles in printing.

The present invention pertains to a thermal transfer sheet formed by providing a thermally-transferable color material layer on one side of a substrate sheet and providing a heat resistant slipping layer on the other side of the substrate sheet with a primer layer interposed between the slipping layer and the substrate sheet, wherein the primer layer is formed by using a conductive colloidal inorganic pigment ultrafine particle.

1 Claim, 1 Drawing Sheet

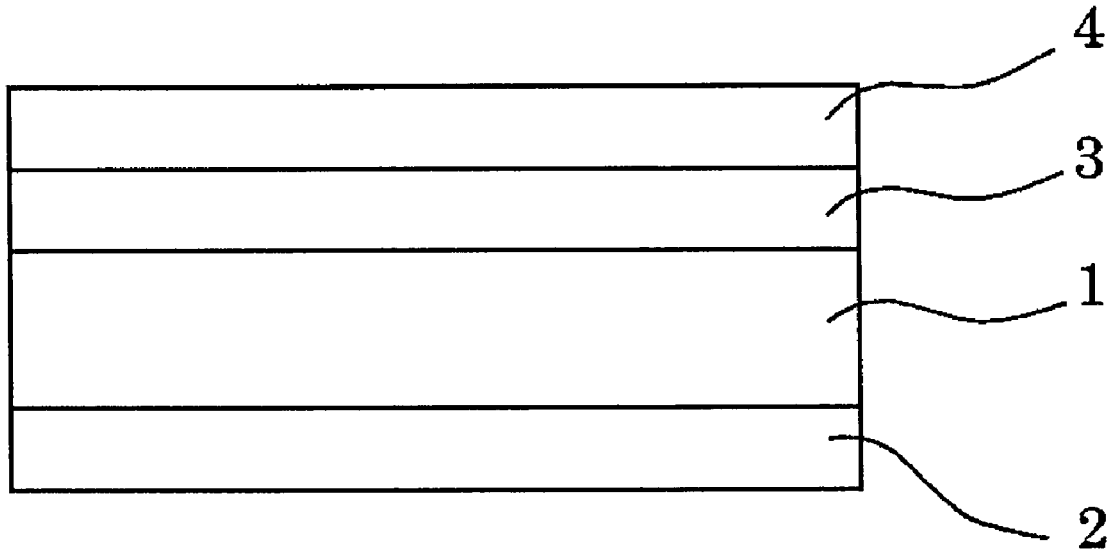
4
3
1
2

THERMAL TRANSFER SHEET

RELATED APPLICATIONS

This application is a national stage application (under 35 U.S.C. §371) of PCT/JP2006/306923 filed Mar. 31, 2006, which claims benefit of Japanese application 2005-105348 filed Mar. 31, 2005, disclosure of which are incorporated herein by reference.

TECHNICAL FIELD

The present invention relates to a thermal transfer sheet.

BACKGROUND ART

As a thermal transfer sheet used for formation of images using thermal transfer, a sublimation thermal transfer sheet in which a dye layer consisting of a thermal diffusion dye (sublimation dye) is provided on a substrate sheet of a plastic film or the like, and a thermofusible thermal transfer sheet in which an ink layer consisting of a pigment and a wax is provided in place of the dye layer are known. These thermal transfer sheets form images by being heated from the backside by a thermal head and transferring a dye in the dye layer or a pigment in the ink layer to a material to which the dye or the pigment is transferred.

In these thermal transfer sheets, when a substrate film is a thermoplastic film, if the formation of images is performed at the thermal head, the surface intrinsic resistivity of a contact surface of the film with the thermal head becomes high, and therefore there was a problem that static electricity is generated and the sheet is apt to be charged. Particularly in the case of the thermofusible thermal transfer sheet, since most of the ink layer is predominantly composed of a wax, this sheet tends to be charged. When the thermal transfer sheet is charged, dust settles on the surface of the thermal transfer sheet or the thermal head and problems that the resolution of images to be formed is deteriorated and that feeding property of the material to which the dye or the pigment is transferred is deteriorated due to charging of the material such as paper.

In order not to cause these problems, hitherto, means for imparting an antistatic property to the thermal transfer sheet has been investigated.

As the means to impart an antistatic property to the thermal transfer sheet, for example, it is known to provide a primer layer containing an antistatic agent (conductive material or the like).

As a thermal transfer sheet provided with the primer layer containing an antistatic agent, a thermal transfer sheet, in which a primer layer containing sulfonated polyaniline as an antistatic agent and a hardening resin such as a polyester resin is provided on the face opposite to a face of the substrate sheet on which a thermally-transferable color material layer is provided with the primer layer interposed between a heat resistant slipping layer and the substrate sheet, is proposed in Patent Document 1.

As a thermal transfer sheet using the same antistatic agent in the same layer constitution as in the sheet described in Patent Document 1, a thermal transfer sheet, in which a binder resin composing the primer layer is limited to a resin (for example, a water-dispersible or water-soluble polyester resin) having specific viscoelasticity, is proposed in Patent Document 2.

As a thermal transfer sheet provided with the primer layer containing an antistatic agent, a heat-sensitive transfer material, which is formed by providing a primer layer of low resistance formed by dispersing a powder of metal oxide such as indium or tin as a conductive agent in a binder resin between the substrate and a thermofusible ink layer, is described in Patent Document 3.

However, in the above technologies of forming a conductive primer layer by use of the conductive agent (antistatic agent) and the binder resin, if the heat resistance of the binder resin is inadequate, there are problems that the primer layer is rubbed off or print wrinkles are produced due to the heat of a thermal head during printing images, and furthermore there is a problem that compatibility between the conductive agent and the binder resin have to be considered and a combination of materials is restricted.

As a thermal transfer sheet prepared by forming a conductive layer using specific metal oxides, a heat-sensitive transfer recording medium, in which a transparent ceramic vapor deposition layer formed by depositing the specific metal oxides by vacuum deposition is provided on the face opposite to a face of a polyester film substrate on which an ink layer is provided as a heat resistant treatment layer, is proposed in Patent Document 4. In Patent Document 4, only $TiO_2$ is used in Examples, but $Al_2O_3$ is exemplified as the specific metal oxide.

Although this recording medium provided with the ceramic vapor deposition layer has heat resistance, a special apparatus is necessary for vapor deposition and there is a problem that a production cost becomes high.

Patent Document 1: Japanese Kokai Publication 2000-272254

Patent Document 2: Japanese Kokai Publication 2001-1653

Patent Document 3: Japanese Kokai Publication Hei-2-20390

Patent Document 4: Japanese Kokai Publication Hei-8-267942

DISCLOSURE OF THE INVENTION

Problems to be Solved by the Invention

In view of the above-mentioned state of the art, it is an object of the present invention to provide a thermal transfer sheet which has a conductive primer layer having adequate adhesion and heat resistance without using a binder resin, has an excellent antistatic property, and hardly causes troubles in printing.

Means for Solving the Problems

The present invention pertains to a thermal transfer sheet formed by providing a thermally-transferable color material layer on one side of a substrate sheet and providing a heat resistant slipping layer on the other side of the substrate sheet with a primer layer interposed between the slipping layer and the substrate sheet, wherein the primer layer is formed by using a conductive colloidal inorganic pigment ultrafine particle.

Hereinafter, the present invention will be described in detail.

The thermal transfer sheet of the present invention, as an aspect of its layer constitution, is for example a sheet formed by forming a thermally-transferable color material layer (2) on one side of a substrate sheet (1) and forming a heat resistant slipping layer (4) on the other side of the substrate sheet with a primer layer (3) interposed between the heat resistant slipping layer and the substrate sheet as shown in FIG. 1.

(Substrate Sheet)

As the substrate sheet in the present invention, materials consisting of various papers or resins, which withstand heating during forming images and have mechanical properties of the level not interfering with handling, can be employed.

Examples of the papers include capacitor paper, paraffin paper and the like.

Examples of the resins include polyethylene terephthalate, 1,4-polycyclohexylene dimethylene terephthalate, polyethylene naphthalate, polyphenylene sulfide, polystyrene, polyethylene, polypropylene, polysulfone, aramide, polycarbonate, polyvinyl alcohol, cellophane, cellulose derivatives such as cellulose acetate and the like, polyvinyl chloride, nylon, polyimide, ionomer and the like, and among others, polyethylene terephthalate, polyethylene naphthalate, or polyester consisting of a mixture thereof is preferred, and polyethylene terephthalate is more preferred.

The substrate sheet in the present invention may be in sheet form or in continuous film form.

A thickness of the substrate sheet may be generally 0.5 to 50 μm, preferably 1 to 10 μm, and more preferably 2 to 6 μm.

For example, when the substrate sheet is a stretched film, unevenness in thickness of the substrate sheet is preferably within ±5% of an average thickness in both a machine direction and a transverse direction from the viewpoint of the traveling property of a thermal head and the prevention of unevenness in printing.

A thickness of the substrate sheet was measured by a micrometer method according to JIS C 2151-1990.

The substrate sheet has excellent adhesion of the primer layer to the substrate since the primer layer is formed by using a conductive colloidal inorganic pigment ultrafine particle, but it is preferred to apply an adhesion treatment to the surfaces of the substrate which form the primer layer and a dye layer in order to further improve the adhesion.

As the adhesion treatment, publicly known modification technologies of a resin surface such as a corona discharge treatment, a flame treatment, an ozone treatment, an ultraviolet treatment, a radiation treatment, an etching treatment, a chemical treatment, a plasma treatment, a low temperature plasma treatment, a primer treatment, and a grafting treatment can be applied. In addition, the adhesion treatment(s) may be applied singly or in combination of two or more species.

In the present invention, among the adhesion treatments, the corona discharge treatment or the plasma treatment is preferred in that these treatments can enhance the adhesion between the substrate and the primer layer without increasing a cost.

(Thermally-Transferable Color Material Layer)

The thermally-transferable color material layer in the present invention is a layer carrying a color material to form printed images and is formed on one side of the substrate sheet.

The thermally-transferable color material layer may be constructed by forming layers having different color materials sequentially on the same substrate surface.

The thermally-transferable color material layer is a dye layer comprising a sublimation dye when the thermal transfer sheet of the present invention is a sublimation thermal transfer sheet, and an ink layer comprising a pigment and a wax when the thermal transfer sheet of the present invention is a thermofusible thermal transfer sheet.

Hereinafter, the dye layer comprising a sublimation dye will be predominantly described, but the thermal transfer sheet of the present invention is not limited to the sublimation thermal transfer sheet.

A binder resin carries the sublimation dye to form the dye layer in the present invention.

As the sublimation dye, dyes used in publicly known sublimation thermal transfer sheets can be used.

Examples of the sublimation dye include diaryl methane dyes; triaryl methane dyes; thiazole dyes; methine dyes such as merocyanine; indoaniline dyes; azomethine dyes such as acetophenoneazomethine, pyrazoloazomethine, imidazoleazomethine, and pyridoneazomethine; xanthene dyes; oxazine dyes; cyanomethylene dyes such as dicyanostyrene and tricyanostyrene; thiazine dyes; azine dyes; acridine dyes; benzeneazo dyes; azo dyes such as pyridoneazo, thiopheneazo, isothiazoleazo, pyrroleazo, pyrazoleazo, imidazoleazo, thiadiazoleazo, triazoleazo and disazo; spiropyran dyes; indolinospiropyran dyes; fluoran dyes; rhodaminelactam dyes; naphthoquinone dyes; anthraquinone dyes; quinophthalone dyes, and the like. A dye is appropriately selected from these dyes in consideration of properties such as a hue, a printing density, lightfastness, storage stability, and solubility in a binder, and used.

The dye is preferably present in an amount 5 to 90% by weight in a dye layer obtained by applying and drying the dye layer, and more preferably present in an amount 10 to 70% by weight.

Examples of the binder resin include cellulose resins such as ethylcellulose, hydroxyethylcellulose, ethylhydroxy cellulose, hydroxypropylcellulose, methylcellulose, cellulose acetate and cellulose butyrate; vinyl resins such as polyvinyl acetal such as polyvinyl alcohol, polyvinyl acetate, and polyvinyl butyral and polyvinylpyrrolidone; acrylic resins such as poly(meth)acrylate and poly(meth)acrylamide; polyurethane resins; polyamide resins; polyester resins; and the like, but among others, cellulose resins, vinyl resins, acrylic resins, polyurethane resins, and polyester resins are preferred in view of heat resistance and dye migration.

The dye layer can be formed by applying a coating solution for a dye layer, which is prepared by appropriately dissolving or dispersing the dye and the binder resin in a solvent or the like, onto one side of the substrate sheet and drying the coating solution.

In the coating solution for a dye layer, the dye can be added in such a way that the dye is contained within the above-mentioned range of the amount in the dye layer.

In the coating solution for a dye layer, the total amount of the dye and the binder resin, namely the concentration of solid matter, can be appropriately selected in accordance with the species or the like of materials to be used, but it is generally 5 to 20% by weight.

The coating solution for a dye layer may be a coating solution to which a publicly known additive is added as required in addition to the dye and the binder resin. Examples of the additive include materials (releasing agents) which are added to a release layer described later, and the like.

The solvent is not particularly limited as long as it is publicly known as a material for the coating solution for a dye layer, and for example, acetone, water, methanol, methyl ethyl ketone, toluene, ethanol, isopropyl alcohol, cyclohexanone, dimethylformamide (DMF), ethyl acetate, mixed solvents of these solvents and the like can be used, and among others, a mixed solvent of methyl ethyl ketone and toluene is preferred.

The coating solution for a dye layer can be applied by publicly known means such as a gravure printing method, a screen printing method and a reverse roll coating method which uses a gravure.

When desired images are in monochrome, the dye layer can be prepared by selecting a dye of one color and forming a layer containing the dye. When desired images are in full color, the dye layer can be prepared by selecting appropriate dyes of, for example, cyan, magenta, and yellow (further, black as required), and forming each layer containing any one of the respective dyes.

An application amount of the dye layer after being dried is preferably about 0.2 to 5 g/m$^2$, and more preferably about 0.4 to 2 g/m$^2$.

In the present invention, a release layer may be provided on the surface of the thermally-transferable color material layer for the purpose of preventing the adhesion of the thermally-transferable color material layer to a thermal transfer image-receiving sheet.

Examples of the release layer include layers formed by depositing an inorganic powder having an anti-adhesive property; and layers consisting of a resin having an excellent releasing property such as a silicone polymer, an acrylic polymer, an fluorinated polymer, or the like.

An application amount of the release layer after being dried is about 0.01 to 5 g/m$^2$, and preferably about 0.05 to 2 g/m$^2$.

(Primer Layer)

The primer layer in the present invention is provided on the face opposite to a face of the substrate sheet on which the thermally-transferable color material layer is provided, and imparts an antistatic property to the thermal transfer sheet, and is provided for adhering the substrate sheet to the heat resistant slipping layer well.

The primer layer is formed by using a conductive colloidal inorganic pigment ultrafine particle.

As the conductive colloidal inorganic pigment ultrafine particle, publicly known compounds, for example, silicate metal salts such as aluminum silicate and magnesium silicate; metal oxides such as alumina or alumina hydrates (alumina sol, colloidal alumina, cationic aluminum oxide or hydrate thereof, pseudo-boehmite and the like), magnesium oxide and titanium oxide; carbonate salts such as magnesium carbonate; and the like can be used, but metal oxides and carbonate salts are preferred, and metal oxides are more preferred, and alumina or alumina hydrates are furthermore preferred, and alumina sol is particularly preferred.

The primer layer may be a layer consisting of only one species of the conductive colloidal inorganic pigment ultrafine particle, or may be a layer consisting of two or more species of the conductive colloidal inorganic pigment ultrafine particles.

An average particle size of the conductive colloidal inorganic pigment ultrafine particle is generally 100 nm or smaller, preferably 50 nm or smaller, and particularly preferably 3 to 30 nm.

When the conductive colloidal inorganic pigment ultrafine particle has an average particle size within the above-mentioned range, effects on the antistatic property and the adhesion described above can be adequately exerted.

In the present invention, the conductive colloidal inorganic pigment ultrafine particle may be a particle which is treated to be brought into an acid type by mixing a dispersion stabilizer such as hydrochloric acid or acetic acid, brought into cations in terms of charge, or surface treated for the purpose of being easily dispersed in a water solvent in sol form.

The conductive colloidal inorganic pigment ultrafine particle in the present invention may be commercially available articles, for example, Alumina Sol 100 (produced by Nissan Chemical Industries, Ltd.), Alumina Sol 200 (produced by Nissan Chemical Industries, Ltd.), and the like.

In the present specification, the average particle size was measured through the observations with an electron microscope.

The primer layer can be formed by applying a aqueous coating solution for a primer layer comprising the conductive colloidal inorganic pigment ultrafine particle onto the substrate sheet and drying the coating solution. The primer layer is more preferably formed by using a sol-gel method described later.

The primer layer has excellent antistatic performance since it can be formed by using the aqueous coating solution for a primer layer, and in addition to this, has good adhesion to the substrate sheet compared with a primer layer formed from a conventional coating solution that is formed by dispersing a conductive material in a binder resin, and is low in a production cost since it can be formed by a simple method such as the sol-gel method without using the binder resin.

The coating solution for a primer layer can be prepared by dispersing the conductive colloidal inorganic pigment ultrafine particle in an aqueous medium.

Examples of the aqueous medium in the coating solution for a primer layer include water, water-soluble alcohols such as isopropyl alcohol, and mixtures of water and water-soluble alcohols, and the like.

In the coating solution for a primer layer, an amount of the conductive colloidal inorganic pigment ultrafine particle is preferably 1 to 300 parts by weight with respect to 100 parts by weight of the aqueous medium.

In the present invention, the coating solution for a primer layer can be applied by publicly known means as with the coating solution for a dye layer.

The coating solution for a primer layer can be applied in such an amount that an application amount of the coating solution after being dried is 0.1 to 10 g/m$^2$, but it can be applied in such an amount that an application amount of the coating solution after being dried is preferably 0.15 g/m$^2$ or more, and more preferably 0.2 g/m$^2$ or more from the viewpoint of imparting an excellent antistatic property, and it can be applied in such an amount that an application amount of the coating solution after being dried is preferably 5 g/m$^2$ or less, and more preferably 3 g/m$^2$ or less in that the antistatic property is enough.

That is, the primer layer in the present invention can exert an antistatic effect even when an amount of the conductive colloidal inorganic pigment ultrafine particle to be used is smaller than conventional conductive materials.

The drying is generally performed by exposing the primer layer to hot air of 90 to 130° C. or the like, so that the conductive colloidal inorganic pigment ultrafine particle becomes a dried gel form from a sol form. Since the primer layer in the present invention is formed by undergoing the drying step, a conductive inorganic pigment ultrafine particle is in a fixed condition, and the primer layer has high strength and its antistatic performance is stable and good. The thermal transfer sheet of the present invention can exert stable antistatic performance independent of environmental changes since it has the primer layer.

In the present specification, an application amount of each coating solution after being dried is determined by weighing each sheet before applying a coating solution to be a measuring object and after applying and drying the coating solution with an analytical balance (AUX 220, manufactured by Shimadzu Corp.), and dividing weight differentials by an area of a portion to which the coating solution is applied.

(Heat Resistant Slipping Layer)

The heat resistant slipping layer in the present invention is formed by using a thermoplastic resin on the primer layer for the purpose of improving heat resistance and a traveling property of a thermal head in printing.

As the thermoplastic resin, thermoplastic resins such as polyester resins; polyacrylic ester resins; polyvinyl acetate resins; styrene acrylate resins; polyurethane resins; polyolefin resins such as polyethylene resins and polypropylene resins; polystyrene resins; polyvinyl chloride resins; polyether resins; polyamide resins; polyimide resins; polyamide imide resins; polycarbonate resins; polyacrylamide resins; polyvinyl chloride resins; polyvinyl butyral resins; and polyvinyl acetal resins such as polyvinyl acetoacetal resins, and silicone modified products thereof and the like are preferred, and polyamide imide resins, silicone modified products thereof and the like are more preferred in view of heat resistance and the like.

The heat resistant slipping layer may be mixed with various additives, for example, thermal release agents such as waxes, higher fatty acid amides, esters, metallic soaps, silicone oils and surfactants; organic powders such as fluororesins; inorganic particles such as silica, clay, talc and calcium carbonate; and the like for the purpose of improving a slipping property in addition to the thermoplastic resin.

The heat resistant slipping layer can be formed by preparing a coating solution for a heat resistant slipping layer, and applying and drying this coating solution.

The coating solution for a heat resistant slipping layer may consist of only the thermoplastic resin and a solvent, or may be formed by adding an additive to be blended as desired in addition to the thermoplastic resin and the solvent.

Examples of the solvent include solvents similar to those described in the above paragraph of the coating solution for a dye layer.

In the coating solution for a heat resistant slipping layer, the concentration of solid matter can be appropriately selected in accordance with the species of a thermoplastic resin to be used or the like, but it is generally 5 to 30% by weight.

An application amount of the heat resistant slipping layer after being dried is preferably 2 g/m$^2$ or less, and more preferably 0.1 to 1 g/m$^2$ in that a thermal transfer sheet having high heat resistance or the like is obtained.

The thermal transfer sheet of the present invention has an excellent antistatic property since it has the primer layer formed by using the conductive colloidal inorganic pigment ultrafine particle as described above.

The thermal transfer sheet of the present invention generally has the surface resistivity of the side of the heat resistant slipping layer within the range of $1.0\times10^4\Omega/\square$ to $1.0\times10^{11}\Omega/\square$ under the circumstances of 23° C., a relative humidity of 60%. The surface resistivity can be preferably set at $1.0\times10^{10}\Omega/\square$ or less, and the surface resistivity may be $1.0\times10^7\Omega/\square$ or more, or may be $1.0\times10^8\Omega/\square$ or more as long as it is within the above range.

In the present specification, the surface resistivity is a value obtained by measuring the surface of the heat resistant slipping layer after a lapse of ten seconds from the start of voltage-application with a surface resistivity meter (Hiresta IP MCP-HT 250, manufacture by DIA INSTRUMENTS CO., LTD.) under the circumstances of 23° C. and a relative humidity of 60% according to JIS K 6911.

(Other Layers)

In the thermal transfer sheet of the present invention, the protection transfer layer may be further formed sequentially together with the thermal transfer color material layer described above on the same face so that a protective layer to protect an image face can be transferred after forming images.

The constitution and formation of the protection transfer layer is not particularly limited, and they can be selected from publicly known technologies in accordance with the characteristics of the substrate sheet to be used, the dye layer to be used or the like.

When the substrate film is not releasable, it is preferred to improve the transferable property of the protection transfer layer by providing a release layer between the substrate film and the protection transfer layer.

The thermal transfer using the thermal transfer sheet of the present invention can be performed by placing the thermal transfer sheet on the surface of a body on which the dye is transferred to form images such as a thermal transfer image-receiving sheet, and providing thermal energy corresponding to desired images to migrate a dye or the like of the thermally-transferable color material layer to the body.

A means for providing the thermal energy may be any one of publicly known means, and the amount of the thermal energy to be provided can be adjusted by controlling a recording time in a recording system such as a thermal transfer printer.

Since the thermal transfer sheet of the present invention has excellent heat resistance, troubles during printing such as print wrinkles do not occur and the traveling property of the thermal head is good even when printing is performed by providing the thermal energy of, for example, about 100 mJ/mm$^2$.

Effects of the Invention

Since the thermal transfer sheet of the present invention has the above-mentioned constitution, it has the excellent adhesion of the primer layer to the substrate sheet and the heat resistant slipping layer, has good heat resistance, and hardly causes troubles in printing.

The thermal transfer sheet of the present invention can be produced at a low production cost since the primer layer can be formed through a coating technique such as a sol-gel method without using a binder resin.

BEST MODE FOR CARRYING OUT THE INVENTION

Hereinafter, the present invention will be described in more detail by way of Examples and Comparative Examples, but the present invention is not limited to these Examples and Comparative Examples.

In addition, "part(s)" or "%" refer to "part(s) by weight" or "% by weight" in Examples and Comparative Examples, unless otherwise specified.

Example 1

A coating solution 1 for a primer layer, having the following composition, was applied onto a substrate sheet (polyethylene terephthalate (PET) film, produced by Toray Industries, Inc., thickness 4.5 μm) in such a way that an application amount after drying was 0.2 g/m$^2$ by gravure coating, and the applied coating solution 1 was dried by being exposed to the hot air of 110° C. for 1 minute to form a primer layer.

Next, a coating solution for a heat resistant slipping layer, having the following composition, was applied onto the primer layer in such a way that an application amount after drying was 0.5 g/m$^2$ by gravure coating, and the applied coating solution was dried at 100° C. for 1 minute to form a heat resistant slipping layer.

Furthermore, a coating solution for a dye layer, having the following composition, was applied onto the face opposite to the face of the substrate sheet on which the heat resistant slipping layer had been provided in such a way that an application amount after drying was 0.7 g/m$^2$ by gravure coating, and the applied coating solution was dried at 80° C. for 1 minute to obtain a thermal transfer sheet 1.

<Coating Solution 1 for Primer Layer> alumina sol (Alumina Sol 100, average particle size 10 to 20 nm, stabilized with hydrochloric acid, produced by Nissan Chemical Industries, Ltd.) 50.0 parts water 25.0 parts isopropyl alcohol 25.0 parts <Coating Solution for Heat Resistant Slipping Layer> polyamide imide resin (HR-15ET, produced by TOYOBO CO., LTD.) 50.0 parts polyamide imide silicone resin (HR-14ET, produced by TOYOBO CO., LTD.) 50.0 parts zinc stearyl phosphate (LBT-1830 purified, produced by Sakai Chemical Industry Co., Ltd.) 10.0 parts zinc stearate (GF-200, produced by NOF CORPORATION) 10.0 parts polyester resin (VYLON 220, produced by TOYOBO CO., LTD.) 3.0 parts inorganic filler (talc, average particle size 4.2 μm) 10.0 parts <Coating Solution for Dye Layer> anthraquinone dye (C.I. solvent blue 63) 3.0 parts polyvinyl butyral resin (S-LEC BX-1, produced by SEKISUI CHEMICAL Co., Ltd.) 3.0 parts methyl ethyl ketone 45.5 parts toluene 45.5 parts

Example 2

A thermal transfer sheet 2 was prepared by following the same procedure as in Example 1 except for forming a primer layer by use of a coating solution 2 for a primer layer having the following composition.

<Coating Solution 2 for Primer Layer> alumina sol (Alumina Sol 200, average particle size 10 to 20 nm, stabilized with acetic acid, produced by Nissan Chemical Industries, Ltd.) 50.0 parts water 25.0 parts isopropyl alcohol 25.0 parts

Comparative Example 1

A thermal transfer sheet 3 was prepared by following the same procedure as in Example 1 except for forming a primer layer by use of a coating solution 3 for a primer layer having the following composition.

<Coating Solution 3 for Primer Layer> sulfonated polyaniline (produced by Nitto Chemical Industry Co., Ltd.) 0.25 parts water-based polyester (POLYESTER WR-961, produced by Nippon Synthetic Chemical Industry Co. Ltd.) 4.75 parts phosphate ester surfactant (PLYSURF 217E, produced by DAI-ICHI KOGYO SEIYAKU CO., LTD.) 0.20 parts water 44.8 parts isopropyl alcohol 50.0 parts

Comparative Example 2

A thermal transfer sheet 4 was prepared by following the same procedure as in Example 1 except for forming a primer layer by use of a coating solution 4 for a primer layer having the following composition.

<Coating Solution 4 for Primer Layer> sulfonated polyaniline (produced by Nitto Chemical Industry Co., Ltd.) 0.6 parts polyvinylpyrrolidone resin (K-15, produced by ISP Japan Ltd.) 6.0 parts water 46.7 parts isopropyl alcohol 46.7 parts

Test Example

The following tests were performed on the thermal transfer sheets obtained in Examples and Comparative Examples.

1. Adhesion

Adhesion of the heat resistant slipping layer side of each thermal transfer sheet was investigated by a peel test by an adhesive tape. As the adhesive tape, a commercially available mending tape (size: 200 mm long×120 mm wide, produced by Nichiban Co., Ltd.) was used.

Criteria of evaluations are as follows.

○: The heat resistant slipping layer was not peeled off from the substrate.

Δ: The heat resistant slipping layer was peeled off from the substrate in part (30% or less of the test area).

X: The heat resistant slipping layer was peeled off from the substrate entirely.

2. Surface Resistivity

The surface resistivity is a value obtained by measuring the surface of the heat resistant slipping layer after a lapse of ten seconds from the start of voltage-application with a surface resistivity meter (Hiresta IP MCP-HT 250, manufacture by DIA INSTRUMENTS CO., LTD.) under the circumstances of 23° C., a relative humidity of 60% according to JIS K 6911.

3. Print Wrinkles

A solid image was printed on a printer-specific roll paper in L size (89 mm×127 mm) with a sublimation printer (manufactured by Mitsubishi Electric Corp., trade name CP-8000D), and a number of print wrinkles generated per one screen of the thermal transfer sheet was visually checked.

Criteria of evaluations are as follows.

○: No print wrinkles

Δ: Number of print wrinkles is 1 to 3

X: Number of print wrinkles is more than 3

4. Heat Damage of Primer Layer

The surface of the heat resistant slipping layer was evaluated after printing under the printing conditions of the above paragraph 3, and it was visually checked whether the primer layer was rubbed off due to heat or not. When the primer layer is rubbed off, thereby the heat resistant slipping layer on the primer layer is also rubbed off.

Criteria of evaluations are as follows.

○: The primer layer was not rubbed off.

X: The primer layer was rubbed off.

The results of the evaluations are shown in Table 1.

TABLE 1

| | Adhesion | Print wrinkles | Heat damage of primer layer | Surface resistivity (Ω/□) |
|---|---|---|---|---|
| Example 1 | ○ | ○ | ○ | $6 \times 10^8$ |
| Example 2 | ○ | ○ | ○ | $7 \times 10^9$ |
| Comparative Example 1 | ○ | X | X | $5 \times 10^9$ |
| Comparative Example 2 | ○ | Δ | ○ | $6 \times 10^9$ |

It was found that the thermal transfer sheets 1 and 2 having the primer layer consisting of alumina sol are superior in both adhesion and heat resistance in addition to an antistatic property.

On the other hand, it was found that the thermal transfer sheet 3 having the primer layer consisting of sulfonated polyaniline and the polyester resin produces heat damage in the primer layer and print wrinkles, and the thermal transfer sheet 4 having the primer layer consisting of sulfonated polyaniline and the polyvinylpyrrolidone resin does not produce heat damage in the primer layer but produces print wrinkles.

INDUSTRIAL APPLICABILITY

Since the thermal transfer sheet of the present invention has the above-mentioned constitution, it has the excellent adhesion of the primer layer to the substrate sheet and the heat resistant slipping layer, has good heat resistance, and hardly causes troubles in printing.

The thermal transfer sheet of the present invention can be produced at a low production cost since the primer layer can be formed through a coating technique such as a sol-gel method without using a binder resin.

BRIEF DESCRIPTION OF THE DRAWING

FIG. 1 is a sectional view showing an example of a thermal transfer sheet of the present invention.

DESCRIPTION OF THE REFERENCE NUMERALS

1 Substrate sheet
2 Thermal transfer color material layer
3 Primer layer
4 Heat resistant slipping layer

The invention claimed is:

1. A thermal transfer sheet formed by providing a thermally-transferable color material layer on one side of a substrate sheet and providing a heat resistant slipping layer on the other side of the substrate sheet with a primer layer interposed between the slipping layer and the substrate sheet, wherein said primer layer is formed by using a conductive colloidal inorganic pigment ultrafine particle and without using a binder resin, wherein said conductive colloidal inorganic pigment ultrafine particle is an alumina sol and wherein the conductive colloidal inorganic pigment ultrafine particle is treated to render it an acid type, or has a cationic charge.

* * * * *